US005964518A

United States Patent [19]

Shen

[11] Patent Number: 5,964,518

[45] Date of Patent: Oct. 12, 1999

[54] FLEXIBLE DECORATIVE LAMP SYSTEM HAVING PLURALITY OF CYLINDRICAL CONNECTORS WITH TRIANGULAR CROSS SECTION THROUGH HOLES FOR CONNECTING LAMP STRIPS IN SERIES

[76] Inventor: Ya-Kuang Shen, 10/F-7, No. 32, Yung-Chi Rd., Taipei, Taiwan

[21] Appl. No.: 08/951,758

[22] Filed: Oct. 16, 1997

[51] Int. Cl.[6] ..... F21S 3/00

[52] U.S. Cl. ..... 362/225; 362/217; 362/219; 362/220; 362/235; 362/249; 362/252; 362/806

[58] Field of Search ..... 362/217, 219, 362/220, 225, 235, 249, 252, 806

*Primary Examiner*—Sandra O'Shea
*Assistant Examiner*—Ronald E. DelGizzi
*Attorney, Agent, or Firm*—Rosenberg, Klein & Bilker

[57] ABSTRACT

A flexible decorative lamp system including a plurality of lamp strips and a plurality of connectors adapted to connect each two lamp strips in series, wherein each connector includes a cylindrical connector body having a longitudinal center through hole of triangular cross section, two terminal elements connected together and mounted in the connector body, and two screw caps respectively fastened to two opposite ends of the connector body to hold two lamp strips in connection to the terminal elements at two opposite sides; the lamp strips have a triangular cross section fitting the longitudinal center through hole of the cylindrical connector body.

2 Claims, 3 Drawing Sheets

FLEXIBLE DECORATIVE LAMP SYSTEM HAVING PLURALITY OF CYLINDRICAL CONNECTORS WITH TRIANGULAR CROSS SECTION THROUGH HOLES FOR CONNECTING LAMP STRIPS IN SERIES

BACKGROUND OF THE INVENTION

The present invention relates to flexible decorative lamp systems, and more particularly to such a flexible decorative lamp system which is comprised of a plurality of flexible lamp strips of triangular cross section connected in series.

During Christmas holidays or certain festivals, people may use decorative light strings to decorate the trees, the houses, etc. Because the bulbs of the decorative light strings are exposed to the outside, they tend to be damaged. There are known decorative lamp systems using flexible plastic tubes to hold decorative light strings. The bulbs of the decorative light strings are mounted in the flexible plastic tubes in transverse direction. Because decorative light strings are mounted in the flexible plastic tubes, they are well protected. However, these decorative lamp systems produce monotonous lighting effect because the flexible plastic tubes have a circular cross section which does not refract light in a three-directional manner.

SUMMARY OF THE INVENTION

The present invention has been accomplished to provide a flexible decorative lamp system which eliminates the aforesaid drawbacks. It is one object of the present invention to provide a flexible decorative lamp system which produces a three-dimensional lighting effect. It is another object of the present invention to provide a flexible decorative lamp system which can be conveniently bent at right angles to fit over wall corners. According to one aspect of the present invention, the flexible decorative lamp system comprises a plurality of lamp strips and a plurality of connectors adapted to connect each two lamp strips in series, wherein each connector comprises a cylindrical connector body having a longitudinal center through-hole of triangular cross section, two terminal elements connected together and mounted in the connector body, and two screw caps respectively fastened to two opposite ends of the connector body to hold two lamp strips in connection to the terminal elements at two opposite sides; the lamp strips have a triangular cross section fitting the longitudinal center through-hole of the cylindrical connector body. According to another aspect of the present invention, the shell of each of lamp strip is provided with at least one V-cut at which the respective lamp strip can be bent at right angles to fit over a corner of a wall.

DETAILED DESCRIPTION OF THE PREFERRED EMBODIMENT

Figure 1:
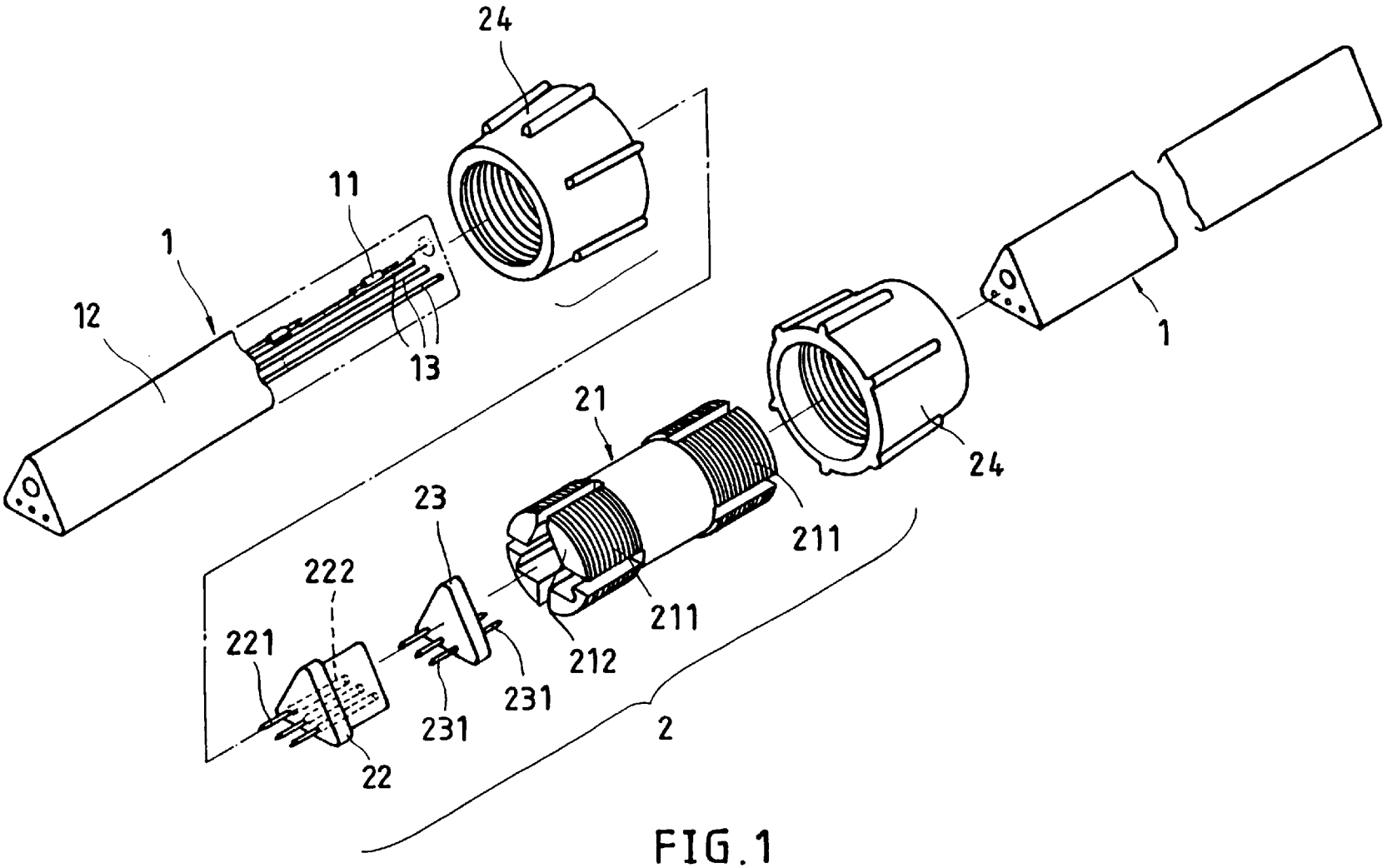
FIG. 1 is an exploded view of a flexible decorative lamp system according to the present invention.
Figure 2:
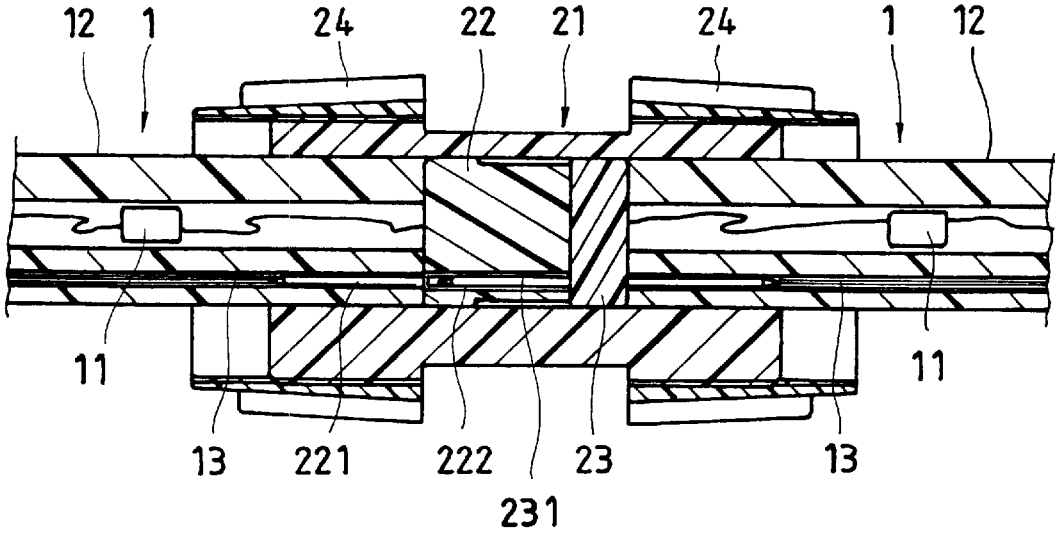
FIG. 2 is a sectional assembly view of the flexible decorative lamp system shown in FIG. 1.

Referring to FIGS. 1 and 2, a flexible decorative lamp system in accordance with the present invention comprises a plurality of lamp strips 1, and a plurality of connectors 2 adapted to connect each two lamp strips 1 in series.

The lamp strip 1 is comprised of a transparent, flexible, elongated shell 12, a light string 11 installed in the shell 12, and two terminal elements 13 respectively connected to two opposite ends of the light string 11 and integral with two opposite ends of the shell 12. The connector 2 comprises a cylindrical connector body 21, a first terminal element 22, a second terminal element 23, and two screw caps 24. The cylindrical connector body 21 has two threaded split extension tubes 211 longitudinally aligned at two opposite ends, and a longitudinal center through-hole 212 of triangular cross section. The first terminal element 22 and the second terminal element 23 are connected together and mounted inside the longitudinal center through-hole 212 of the cylindrical connector body 21. The first terminal element 22 has male terminals 221 at one end adapted for fastening to one terminal element 13 of a first lamp strip 1, and female terminals 222 at an opposite end. The second terminal element 23 has male terminals 231 at two opposite ends respectively fastened to the female terminals 222 of the first terminal element 22 and one terminal element 13 of a second lamp strip 1. Further, the shell 12 of each lamp strip 1 has a triangular cross section fitting the longitudinal center through-hole 212 of the cylindrical connector body 21. When two lamp strips 1 are respectively inserted into the longitudinal center through-hole 212 of the cylindrical connector body 21 and respectively connected to the first terminal element 22 and the second terminal element 23, the screw caps 24 are respectively sleeved onto the lamp strips 1 and threaded onto the threaded split extension tubes 211 of the cylindrical connector body 1 to fix the lamp strips 1 and the cylindrical connector body 1 together. When the light strings 11 of the lamp strips 1 are turned on, the shell 12 of each lamp strip 1 refracts the light of the respective light string 11 in different directions to produce a fantastic lighting effect.

Figure 3:
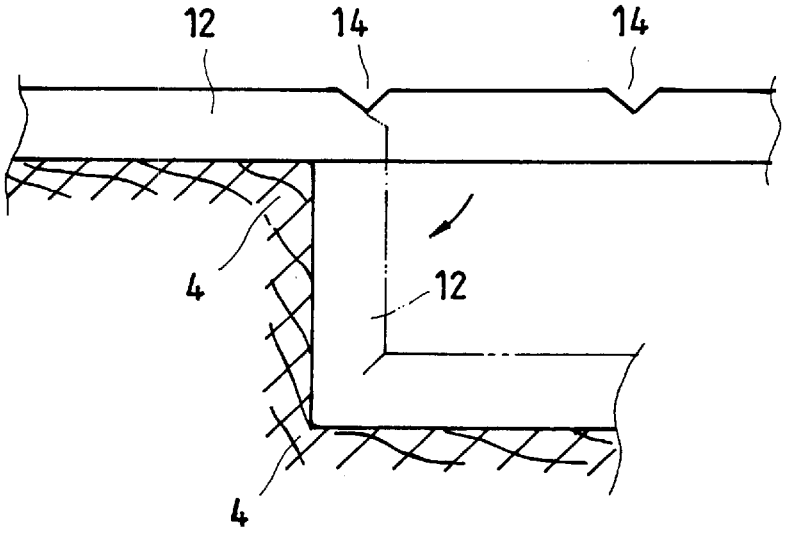
FIG. 3 is an applied view of the present invention, showing V-cuts made at the shell of the lamp strip, the lamp strip bent at right angles and attached to corners of a wall.

Referring to FIG. 3, V-cuts 14 may be made on the shell 12 of each lamp strip 1, so that the lamp strip 1 can be bent at right angles to fit corner areas of a wall. As previously discussed, shell 12 is flexible and thus may be conformed to the corners of the wall 4 as shown in FIG. 3. V-cuts 14 as shown in FIG. 3 may be formed through the flexible shell 12 by any conventional mechanism such as knife blades or other type of cutting mechanism, not important to the invention as herein described and as is well-known in the art. The depth of the V-cut 14 is not important to the inventive concept, but must obviously pass through a wall of the shell 12, as shown, without penetrating the light string 11.

Figure 4:
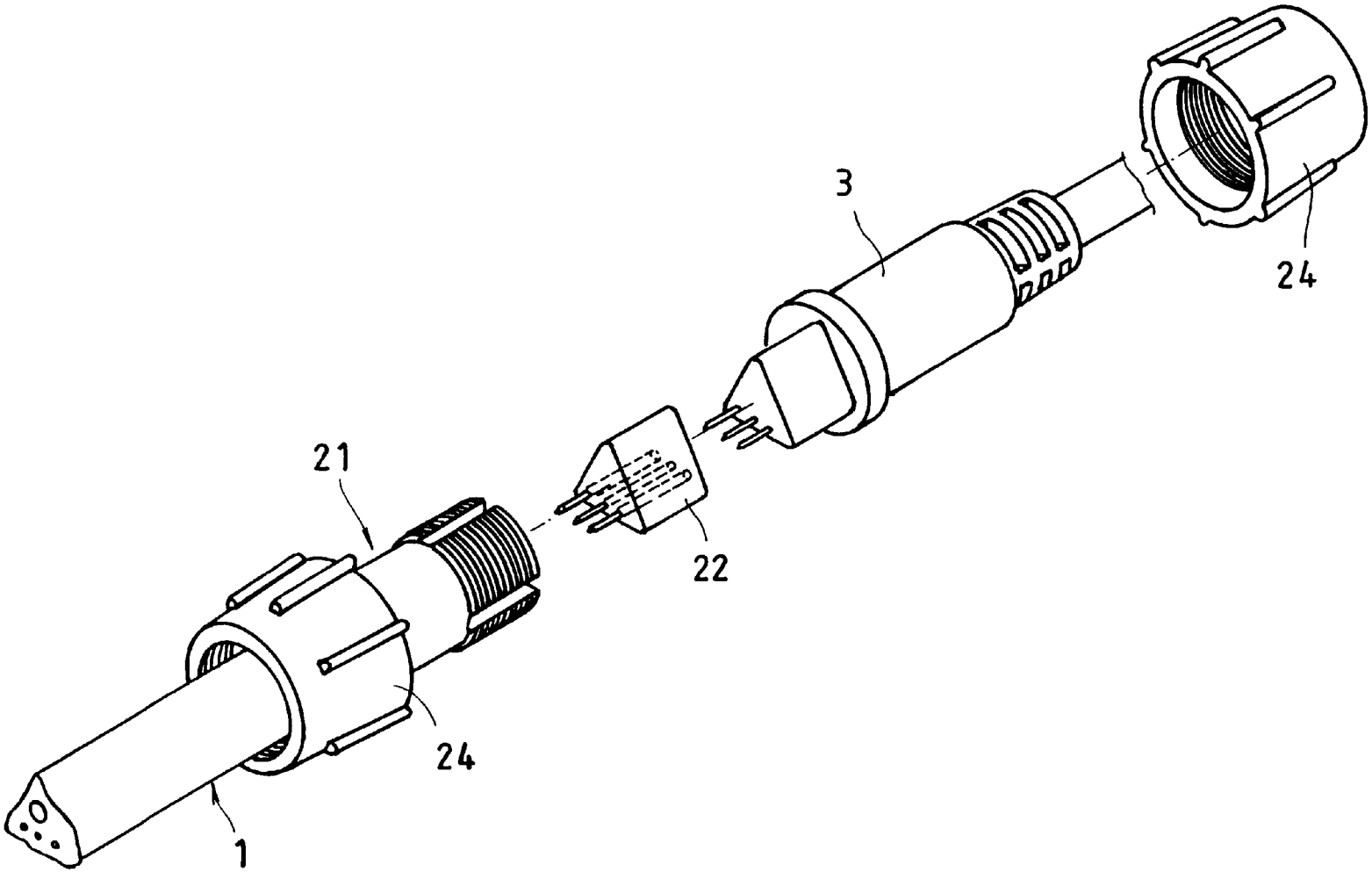
FIG. 4 is another applied view of the present invention, showing a connection of a power cable to the connector.

Referring to FIG. 4, the aforesaid second terminal element 23 may be removed from the connector 2, so that a power cable 3 can be directly connected to the female terminals 222 of the terminal element 22.

While only one embodiment of the present invention has been shown and described, it will be understood that various modifications and changes could be made thereunto without departing from the spirit and scope of the invention disclosed.

What the invention claimed is:

1. A flexible decorative lamp system comprising a plurality of lamp strips and a plurality of connectors adapted to connect each two lamp strips in series, wherein:

each of said connectors comprises a cylindrical connector body, a first terminal element, a second terminal element, and two screw caps, said cylindrical connector body having two threaded split extension tubes longitudinally aligned at two opposite ends, and a longitudinal center through-hole of triangular cross section, said first terminal element and the second terminal element being connected together and mounted inside the longitudinal center through-hole of said cylindrical connector body, said first terminal element having a plurality of male terminals at one end adapted for fastening to one terminal element of one lamp strip, and a plurality of female terminals at an opposite end, said second terminal element having male terminals at two opposite ends respectively fastened to the female terminals of said first terminal element and one terminal element of one lamp strip;

each of said lamp strips is comprised of a transparent, flexible, elongated shell having a triangular cross section adapted to engage into the longitudinal center through hole of one of said connectors, a light string installed in said shell, and two terminal elements respectively connected to two opposite ends of said light string and integral with two opposite ends of said shell.

2. The flexible decorative lamp system of claim 1, wherein the shell of each of said lamp strips is provided with at least one V-cut passing through a wall of the shell, at which the respective lamp strip can be bent at right angles to fit over a corner of the wall.

* * * * *